US005811921A

United States Patent [19]

Ligthart et al.

[11] Patent Number: 5,811,921

[45] Date of Patent: Sep. 22, 1998

[54] THIN-PANEL DISPLAY HAVING RESISTIVE SPACER PLATE

[75] Inventors: Henricus J. Ligthart; Jan W. Kleine; Harm Tolner; Hermanus N. Tuin, all of Eindhoven, Netherlands

[73] Assignee: U.S. Philips Corporation, New York, N.Y.

[21] Appl. No.: 962,945

[22] Filed: Jun. 19, 1997

Related U.S. Application Data

[63] Continuation of Ser. No. 437,639, May 9, 1995, abandoned.

[30] Foreign Application Priority Data

May 11, 1994 [EP] European Pat. Off. ..... 94201337

[51] Int. Cl.[6] ..... H01J 29/08

[52] U.S. Cl. ..... 313/422; 313/480; 313/496; 313/103 CM; 315/169.1

[58] Field of Search ..... 313/103 R, 103 CM, 313/495, 496, 497, 422, 399, 400, 480; 315/169.1, 169.3; 501/60, 61, 62

[56] References Cited

U.S. PATENT DOCUMENTS

| | | | |
|---|---|---|---|
| 4,179,638 | 12/1979 | Boyd et al. | 501/62 |
| 4,566,893 | 1/1986 | Hopkins et al. | 65/117 |
| 4,886,996 | 12/1989 | Field et al. | 313/400 |
| 5,108,960 | 4/1992 | Boek et al. | 313/480 |
| 5,192,718 | 3/1993 | Danielson | 501/60 |
| 5,313,136 | 5/1994 | Van Gorkom et al. | 313/422 |
| 5,347,199 | 9/1994 | Van Gorkom et al. | 313/422 |
| 5,468,692 | 11/1995 | Boek et al. | 313/480 |
| 5,599,752 | 2/1997 | Piers et al. | 501/62 |

FOREIGN PATENT DOCUMENTS

| | | | |
|---|---|---|---|
| 0464937 | 1/1992 | European Pat. Off. | H01J 31/12 |
| 0499039 | 8/1992 | European Pat. Off. | H01J 29/86 |
| 4208750 | 10/1992 | European Pat. Off. | H01J 29/56 |

OTHER PUBLICATIONS

Data sheet on High Purity Alumina, Malahoff Industries, Inc. P.O. Box 27002, Richmond VA 23261, Apr. 1, 1994.

Procedures in Experimental Physics, by Strong; Prentice Hall; Inc. pp. 4 & 5.

*Primary Examiner*—Sandra L. O'Shea
*Assistant Examiner*—Michael Dav
*Attorney, Agent, or Firm*—Robert J. Kraus

[57] ABSTRACT

A display device includes: a rear wall (4); a display panel (3) spaced from the rear wall (4) and a display screen (7) having a pattern of phosphor pixels; an addressing structure (100) disposed intermediate the rear wall (4) and the display panel (3) for addressing the display screen (7); and an aperture spacer plate (101); wherein, the spacer plate (101) includes a glass material having an electrical resistance of log R at 250° C.≧8. The spacer plate (101) including a glass material having an electrical resistance of log R at 250° C.≧8 reduces the charging of the spacer plate walls and improves uniformity of phosphor brightness. The spacer plate may further comprise a glass having a lower alkali mobility less than sodium lime glass.

21 Claims, 4 Drawing Sheets

THIN-PANEL DISPLAY HAVING RESISTIVE SPACER PLATE

This is a continuation of application Ser. No. 08/437,639, filed May 9, 1995, now abandoned.

BACKGROUND OF THE INVENTION

The invention relates to a picture display device having an envelope which is provided with a transparent face plate and a display screen having a pattern of phosphor pixels, and with a rear wall, comprising electron source means with an addressing system arranged between said means and the face plate so as to address the desired pixels, and, adjacent to the display screen, an apertured spacer plate of electrically insulating material for passing electrons, while in operation a voltage difference is present across the thickness of said plate.

The display device described above is of the thin-panel type. Display devices of the thin-panel type are, for example cathode ray tube devices having a transparent face plate and, arranged at a small distance therefrom, a rear plate, while a pattern of phosphor dots is provided on the inner surface of a face plate. If (picture information-controlled) electrons impinge upon the luminescent screen, a visual image is formed which is visible via the front side of the face plate. The face plate may be flat or, if desired, curved (for example, spherical or cylindrical). Another type of thin-panel display device is, for example the field emission display or the plasma display in which a number of gas discharge cells are arranged in a matrix, which cells are addressed by means of two sets of crossing electrodes. A gas discharge in a cell produces UV radiation which excites one or more cell-associated phosphors.

A thin-panel display device described in U.S. Pat. No. 5,313,136 (+PHN 12.927) comprises a plurality of sources for emitting electrons, electron propagation means cooperating with the sources, each having a wall of a high-ohmic, electrically substantially insulating material having a secondary emission coefficient which is suitable for propagating emitted electrons, and an addressing system comprising electrodes (selection electrodes) which can be driven row by row so as to extract electrons from the propagation means at predetermined extraction locations facing the luminescent screen, while further means are provided for directing extracted electrons towards phosphor pixels of the display screen for producing a picture composed of pixels.

The operation of the picture display device disclosed in U.S. Pat. No. 5,313,136 is based on the recognition that electron propagation is possible when electrons impinge on a wall of a high-ohmic, electrically substantially insulating material (for example, glass or synthetic material), if an electric field of sufficient power is generated across a given length of the wall (by applying a potential difference across the ends of the wall). The impinging electrons then generate secondary electrons by wall interaction, which electrons are attracted to a further wall section and in their turn generate secondary electrons again by wall interaction, and so forth: the phenomenon known as hopping.

Starting from the above-mentioned principle, a thin-panel picture display device can be realised by providing a plurality of "compartments", which constitute propagation ducts, with addressable extraction apertures at their side which is to face the display screen, so that electrons can be selectively extracted from the "compartments" and directed (and accelerated) towards the screen for producing a picture composed of pixels by activating the pixels.

EP-A-464 937 particularly describes a stepped addressing system having a preselection plate with a pattern of addressable preselection (or coarse-selection) apertures and a fine-selection plate with a pattern of addressable fine-selection apertures. The preselection plate and the fine-selection plate may be separated from each other by one or more spacer plates which are provided with apertures to pass electrons. A stepped selection system using a number of preselection extraction locations which is reduced with respect to the number of pixels, and a directly or indirectly associated number of (fine-)selection apertures which corresponds to the number of phosphor pixels provides advantages with respect to, for example the extraction efficiency and the required number of electric connections/drivers.

The luminescent screen is also referred to as the phosphor screen. An important component of the above-mentioned display devices is the screen spacer, an apertured plate of a dielectric material which is used as a vacuum support and may also serve to prevent "crosstalk" between the pixels.

The screen spacer is adjacent to the phosphor screen. Due to the efficiency and the saturation behaviour of the phosphor, it is of crucial importance that the acceleration voltage to the phosphor screen is as high as possible. Dependent on the phosphors used, 1 kV or, more frequently, 4 to 5 kV is a minimum requirement. To be able to realize this voltage difference, a number of measures with respect to the screen spacer should be taken.

The (fine)-selection plate, the screen spacer and the face plate are made of an insulating material, particularly glass. A patterned metallization, for example nickel, aluminium or copper is provided on the (fine)-selection plate. The face plate is provided with a low-ohmic transparent conducting coating, for example ITO. This coating is provided with a phosphor pattern (the flu) and (possibly) a black matrix; the flu current is depleted via the conducting coating. A typical thickness of the screen spacer is 0.1–1.0 mm. The voltage difference between the fine-selection electrodes and the ITO coating on the screen should now be sufficiently high to drive the phosphors efficiently.

In practice, inexplicable picture errors appear to have occurred so far, which become manifest as a non-uniform brightness or patchiness. Examinations within the scope of the invention have shown that these errors are current-dependent. This means that position or landing errors are involved which are caused by the fact that the position (and the shape) of the spot on the luminescent screen is dependent on the current.

SUMMARY OF THE INVENTION

It is an object of the invention to provide a device of the type described in the opening paragraph which has an improved behaviour as regards the above-mentioned errors.

To this end a device of the type described in the opening paragraph is characterized in that the spacer plate consists of a glass material having an electrical resistance R (in Ωcm) which complies with the requirement log R (Ωcm)≧8 at 250° C.

The invention is based on the recognition that, if the intensity of the current changes, the wall potential of the apertures in the spacer plate may change when the electrical resistance is not high enough. When electrons pass through the apertures towards the screen, the walls of the apertures will generally be charged. This charging is mainly effected in that electrons are backscattered from the luminescent screen. A difference in wall condition (charge) may give rise to the fact that the electron beam does not always impinge the centre of an aperture-associated phosphor pixel. The position of the spot is then unstable, which leads to uniformity errors (patchiness).

The window glass or (natron) lime glass hitherto used most frequently because of its flatness and availability in desired sizes has a resistance R (in Ωcm) for which it holds that log R (Ωcm)<7 (at 250° C.). According to the invention, log R should be at least equal to 8 to prevent spot displacements. It is even better to use a material with log R (Ωcm)≧10, and preferably, log R (Ωcm)≧12.

Apart from the fact that they have to comply with the above-mentioned resistance requirement, it is important for a satisfactory processing that the plates used, i.e. not only the apertured spacer plate but also the face plate and the rear wall and/or the possible further internal (spacer) plates, differ by less than $1\times10^{-6}$ in their linear coefficient of expansion (which is in the units of length/[°C. or °K.]). Further, the process of making the apertures in the plates should not take more time than the process of making apertures in window glass. Borosilicate glass appears to be very satisfactory. It was found that borosilicate glass could be provided with patterns of apertures almost as rapidly as window glass by means of a powder spraying process and a mask. It was even found that a plurality of narrow, closely spaced ducts as required, for example for given types of flat, thin displays for the duct plate could be ground by means of a grinding wheel in borosilicate glass at a considerably faster rate and even twice faster than in window glass. This renders it possible to provide the ducts in an economically justified way by means of a relatively slow lapping process instead of by grinding. A slowly reciprocating metal cutting blade and a grinding means are used for the lapping operation. This has the advantage that the temperature of the glass plate hardly rises so that higher tolerances can be achieved and breakage due to the occurrence of tensions occurs less frequently. An additional advantage of borosilicate glass plates, when used in display devices, in which a voltage is present across the plates, is that they have a considerably longer lifetime than window glass plates.

Glass plates (spacers) on which a metallization pattern (for example a pattern of addressing electrodes) is provided and across which considerable electric voltages are applied in operation, often appear to show interruptions in the metallization pattern in practice. The invention is based on the further recognition that such interruptions are caused by local loosening of the metal layer. This loosening phenomenon occurs when the glass material comprises a substantial quantity of alkali metal such as particularly Na which may diffuse towards a surface under the influence of the applied voltage. To prevent this phenomenon, glass having an essentially lower alkali mobility, e.g. alkali-free glass, alkali-poor glass, or glass which in addition to Na comprises a comparable quantity of K, i.e. mixed-alkali glass is to be used. (K inhibits the mobility of Na and conversely. The $Na^+$ mobility in the absence of K is $10^{-10}$ to $10^{-11}$ $cm^2/Vs$).

Problems may also occur in other glass plates without any other metallization than the spacer plate across which an electric voltage is present in operation (for example a plate across which electrons hop). The invention is based on the recognition that these problems are based on the fact that the secondary emission coefficient changes when alkali material migrates towards the surface. The electron transport process may be disturbed thereby. The above-mentioned requirements should therefore also be imposed in this case.

These and other aspects of the invention will be apparent from and elucidated with reference to the embodiments described hereinafter.

BRIEF DESCRIPTION OF THE DRAWINGS

Identical components are denoted by the same reference numerals.

DESCRIPTION OF THE PREFERRED EMBODIMENTS

Figure 1A:
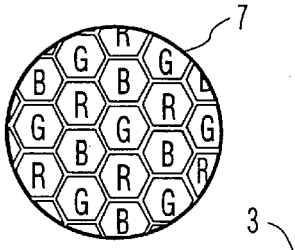
FIG. 1 is a diagrammatic perspective elevational view, partly broken away, of a part of a (colour) display device with electron propagation ducts, an addressing system with an apertured preselection plate, an apertured fine-selection plate and a screen spacer whose components are not shown to scale.
Figure 1:
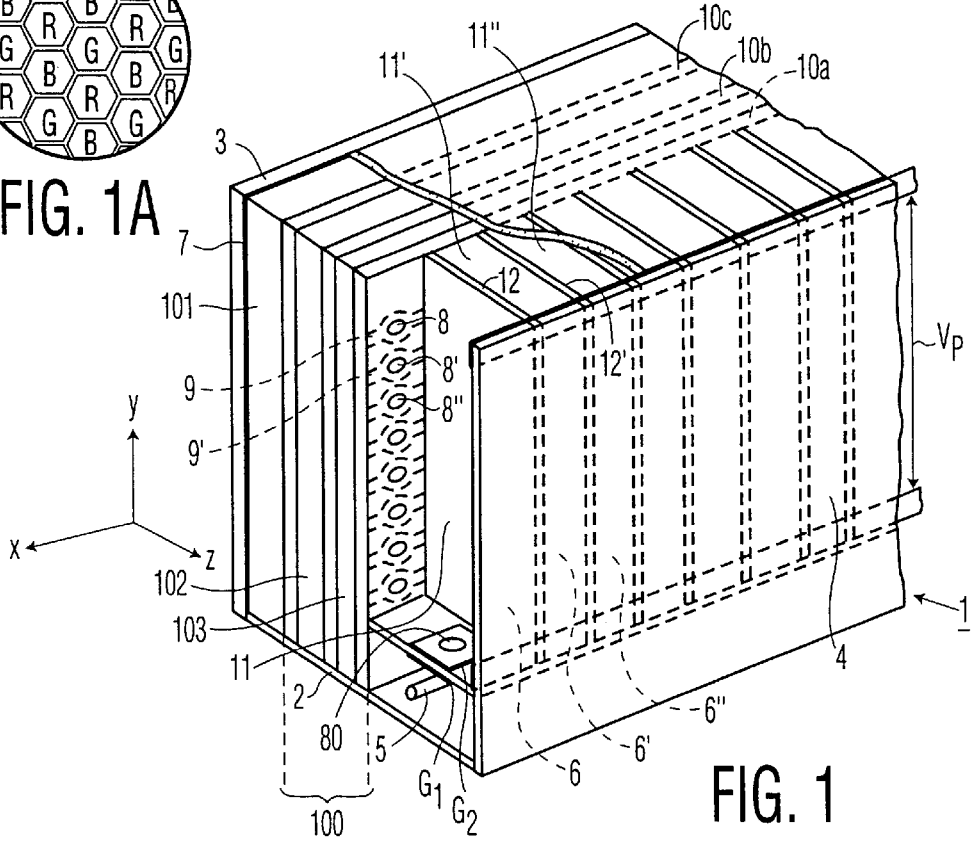

FIG. 1 shows a thin-panel picture display device of the type using electron propagation ducts, having a display panel (window) 3 and a rear wall 4 located opposite said panel. A display screen 7 having a (for example, hexagonal) pattern of red (R), green (G) and blue (B) luminescing phosphor pixels is arranged on the inner surface of window 3. In the embodiment shown triplets of phosphor elements are arranged in tracks transverse to the long axis of the display screen, i.e. they are vertically staggered, see inset, but the invention is not limited thereto. For example, a horizontally staggered arrangement is also possible.

An electron source arrangement 5, for example a line cathode which by means of electrodes provides a large number of electron emitters, for example 600, or a similar number of separate emitters, is arranged proximate to a wall 2 which interconnects panel 3 and rear wall 4. Each of these emitters is to provide a relatively small current so that many types of cathodes (cold or hot cathodes) are suitable as emitters. The emitters may be driven by a video drive circuit. The electron source arrangement 5 is arranged opposite entrance apertures of a row of electron propagation ducts extending substantially parallel to the screen, which ducts are constituted by compartments 6, 6', 6", . . . etc., in this case one compartment for each electron source. These compartments have cavities 11, 11', 11", . . . defined by the rear wall 4 and partitions 12, 12', . . . . The cavities 11, 11', . . . may alternatively be provided in the rear wall 4 itself. At least one wall (preferably the rear wall) of each compartment should have a high electrical resistance which is suitable for the purpose of electron propagation with wall interaction in the propagation direction, and have a secondary emission coefficient δ>1 over a given range of primary electron energies, or should be provided with a coating having such properties. An axial propagation field is generated in the compartments by applying a potential difference $V_p$ across the height of the compartments 6, 6', 6", . . . .

The electrical resistance of the wall material has such a value that a minimum possible total amount of current (preferably less than, for example 10 mA) will flow in the walls at a field strength in the axial direction in the compartments of the order of one hundred to several hundred volts per cm required for the electron propagation. By applying a voltage of the order of several dozen to several hundred volts (value of the voltage is dependent on circumstances) between the row 5 of electron sources and the compartments 6, 6', 6", electrons are accelerated from the electron sources towards the compartments, whereafter they impinge upon the walls in the compartments and generate secondary electrons.

The invention utilizes the aspect disclosed in U.S. Pat. Nos.5,313,136 and 5,347,199; that vacuum electron transport within compartments having walls of high-ohmic electrically substantially insulating material is possible if an electric field of sufficient power is applied in the longitudinal direction of the compartments. U.S. Pat. Nos. 5,313,136 and 5,347,199 are incorporated herein; by reference.

Figure 2:
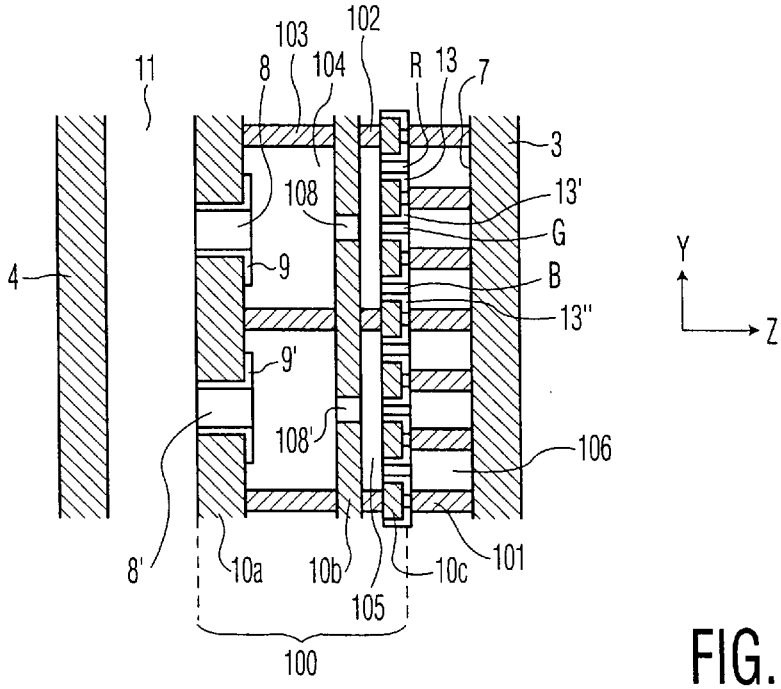
FIG. 2 is a diagrammatic cross-section through a part of a device of the type shown in FIG. 1.
Figure 3:
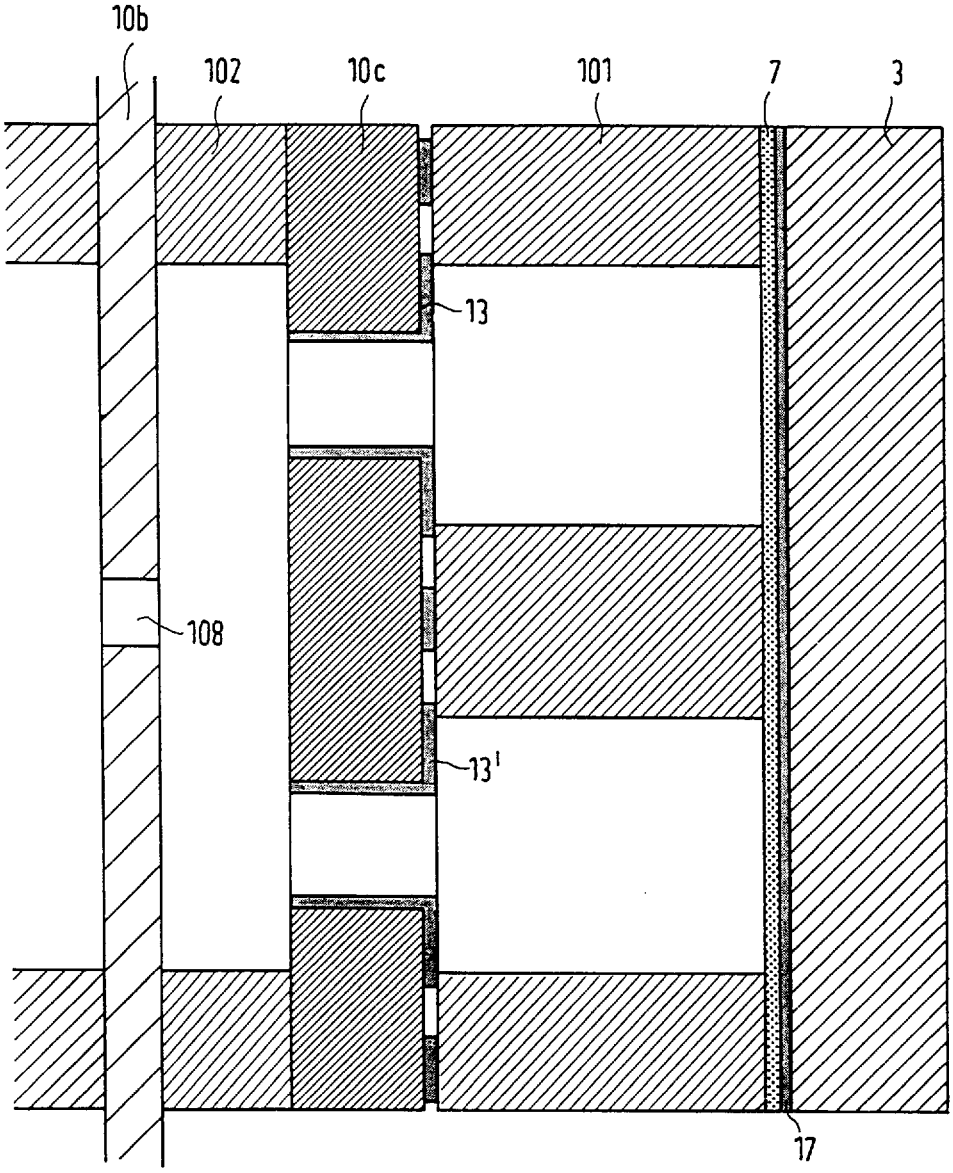
FIG. 3 shows a larger detail of FIG. 2.

The space between the compartments and the luminescent screen 7, which is arranged on the inner wall of panel 3, accommodates a (stepped) addressing system 100 which comprises an (active) preselection plate 10*a*, a (passive) obstruction plate 10*b* and an (active) (fine-)selection plate 10*c* (see also FIG. 2). Structure 100 is separated from the luminescent screen 7 by a screen spacer 101 formed as an apertured plate of electrically insulating material.

FIG. 2 shows in a diagrammatical cross-section a part of the display device of FIG. 1 in greater detail, particularly the addressing structure 100 comprising preselection plate 10*a* with apertures 8, 8', 8", . . . , and fine-selection plate 10*b* with groups of apertures R, G, B. Three fine-selection apertures R, G, B are associated with each preselection aperture 8, 8', etc. in this case. In the diagrammatic FIG. 2, the apertures R, G, B are coplanar. However, in reality they are arranged in a configuration corresponding to the phosphor dot pattern (see FIG. 1). In this case, an apertured obstruction plate 10*b* having apertures 108, 108", . . . is arranged between the preselection plate 10*a* and the fine-selection plate 10*c*, which obstruction plate prevents electrons from the propagation ducts 11 from impinging upon the display screen straight through a fine-selection aperture (known as unwanted "direct hits").

Electron propagation ducts 6 with transport cavities 11, 11', . . . are formed between the structure 100 and rear wall 4. To be able to extract electrons from the ducts 6 via the apertures 8, 8', . . . , addressable, metal preselection electrodes 9, 9', etc. extending from aperture to aperture and surrounding the apertures are arranged in ("horizontal") rows parallel to the long axis of the display screen on, for example the display screen side of the plate 10*a*.

The walls of the apertures 8, 8', . . . may be metallized.

Similarly as the plate 10*a*, the fine-selection plate 10*c* is provided with "horizontally oriented" addressable rows of (fine-)selection electrodes for realising fine selection. The possibility of directly or capacitively interconnecting corresponding rows of fine-selection electrodes is important in this respect. In fact, a preselection has already taken place and, in principle, electrons cannot land at the wrong location. This means that only one group, or a small number of groups of three separately formed fine-selection electrodes is required for this mode of fine selection.

The preselection electrodes 9, 9', . . . are subjected to a linearly increasing DC voltage, for example by connecting them to a voltage divider. The voltage divider is connected to a voltage source in such a way that the correct potential distribution to realise electron transport in the ducts is produced across the length of the propagation ducts. Driving is effected, for example by applying a pulse (of, for example 250 V) for a short period of time to consecutive preselection electrodes and to apply shorter lasting pulses of, for example 200 V to the desired fine-selection electrodes. It should of course be ensured that the line selection pulses are synchronized with the video information. The video information is applied, for example to the individual $G_1$ electrodes which drive the emitters (FIG. 1), for example in the form of a time or amplitude-modulated signal.

It should be noted that several variants of the construction comprising the obstruction plate 10*b* as shown in FIG. 2 are possible. For example, the plate 10*b* may be combined to one unit with one or both spacer plates 102, 103 at both sides. In this case, the spacer plate 103 is referred to as the coarse-selection spacer and spacer plate 102 is referred to as the obstruction plate spacer or "chicane" spacer.

When electrons are passed through the, apertures in the fine-selection electrodes 13, 13', 13" . . . , the walls of the screen spacer will be charged. This charging is mainly effected by electrons which are backscattered from the phosphor screen and generate secondary electrons on the spacer walls, which electrons in their turn are transported to the phosphor screen. It appears to be favourable to ensure that the walls of the screen spacers are poor secondary emitters, either by selecting suitable spacer material, or by providing a suitable coating; the latter seems to be the easiest way. With a view to suppression of field emission, the maximum secondary emission coefficient $\delta$ is smaller than 1 in the ideal case. Suitable coatings, which can be realised in practice generally have a $\delta_{max}$ of between 1 and 4. It stands to reason that said coating should also have a sufficiently high-ohmic value so that the fine-selection side of the screen spacer is not "short-circuited" with the screen side.

By suitable choice of the shape of the screen spacer apertures, the electric field at the fine-selection electrodes and hence unwanted field emission can be decreased.

It has appeared to be favourable to give the apertures in the screen spacer a conical shape so that the aperture diameter increases from selection electrodes to the phosphor screen.

The last-mentioned condition can be met more easily within the scope of the invention because plates of borosilicate glass having thicknesses of less than 0.5 mm are available. Spacer apertures of the desired diameter will generally not be purely conical in thicker plates, but acquire the shape of a funnel with a shank.

Figure 4A:
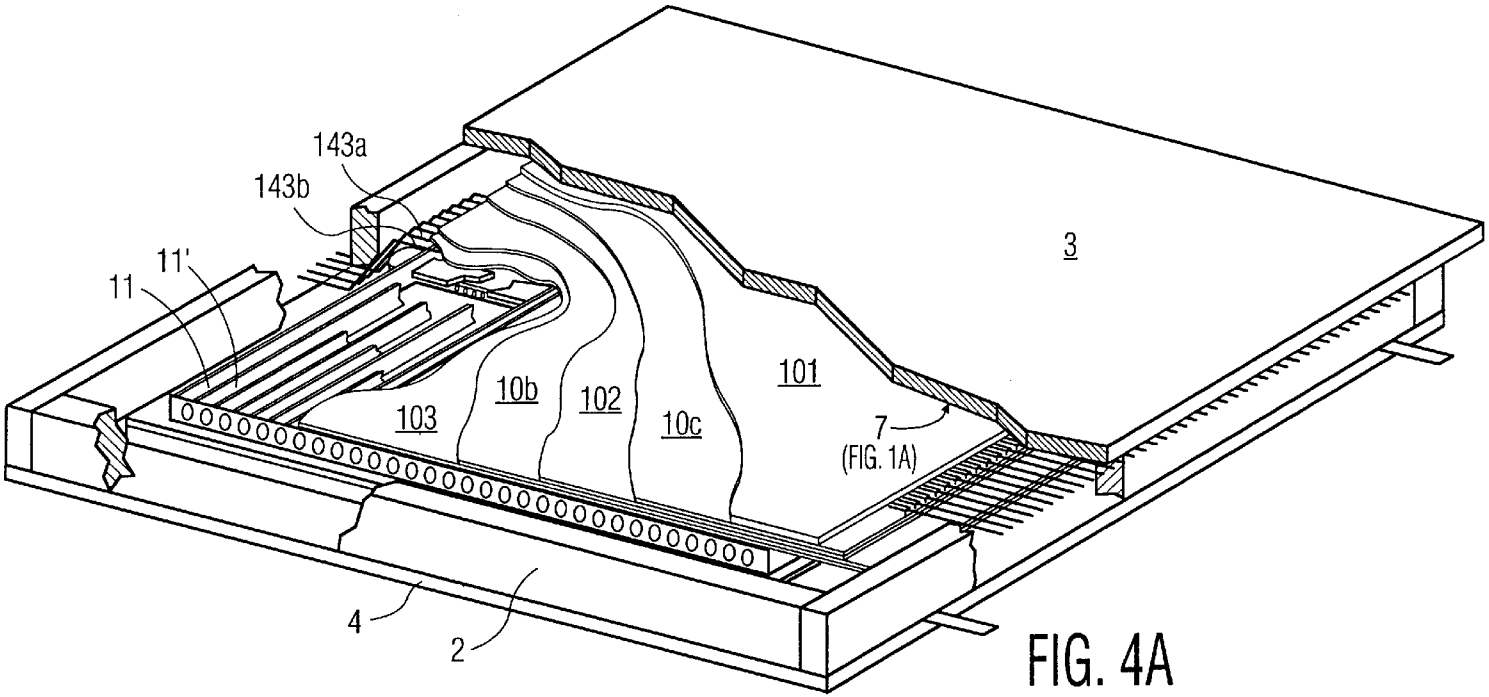
FIG. 4 is a perspective elevational view, partly broken away, of an embodiment of a display device according to the invention.
Figures 4B, 4C, 4D, 4E, 4F, 4G, 4H:
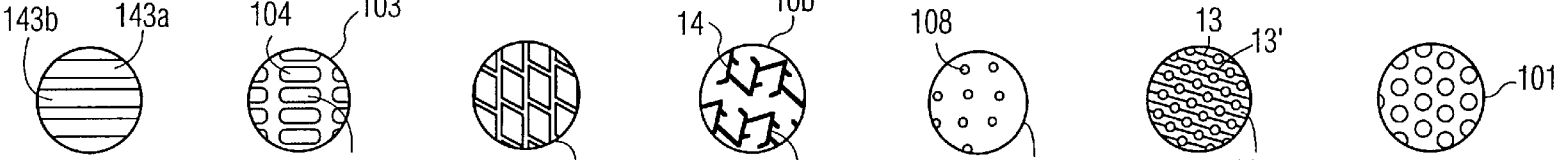

FIG. 4 illustrates the structure of a thin-panel display of the type having electron propagation ducts. A box-shaped construction with a transparent face plate 3 whose inner side is provided with a luminescent phosphor screen 7, and a real wall 4 can be distinguished. At their circumference these walls are connected by side walls 2, etc. A perforated screen spacer plate 101 is adjacent to the luminescent screen 7. Then a perforated fine-selection plate 10*c* follows, with a pattern of pierced fine-selection electrodes 13, 13', . . . at its upper face. An important part is the obstruction plate 10*b* provided with a pattern of small apertures (108), which plate is spaced apart from the fine-selection plate 10*c* by a spacer plate 102. Obstruction plate 10*b* ensures that electrons extracted from the transport ducts always impinge on a wall at least once before they are extracted through the fine-selection apertures. Spacer plate 102 has parallelogram-shaped apertures in this case. In an alternative embodiment the apertures may have, for example a triangular shape. On its top face, the obstruction plate 10*b* has a pattern of electron collection electrodes 14, 14', . . . . The bottom face of obstruction plate 10*b* is adjacent to the spacer plate 103. In this case, spacer plate 103 is provided with a pattern of slotted apertures 104, 104', . . . . In this case, gauze strips 143*a*, 143*b*, . . . extend across the slotted apertures 104, 104', . . . at the lower side of the spacer plate 103. The gauze strips 143*a*, 143*b*, . . . constitute preselection electrodes and are adjacent to the electron transport ducts 11, 11', . . . where they constitute extraction locations. A (more customary) alternative for the gauze strips is an apertured preselection plate such as plate 10*a* in FIG. 2, in which preselection electrodes (9, 9', . . . ) are provided proximate to the apertures on one of the surfaces. Electrons may be injected into the transport ducts in different ways.

A method of providing the large numbers of apertures in the plates is particularly powder spraying via a mask provided with the desired aperture pattern.

Suitable glass materials within the scope of the invention are mixed-alkali glasses and particularly borosilicate glasses. Suitable glasses having a resistance R (in Ωcm) which satisfies log R (250° C.) of at least 9 have, for example one of the following compositions (% by weight), apart from possible small impurities:

| | | | |
|---|---|---|---|
| $SiO_2$ | 71.9 | $SiO_2$ | 60 |
| $Na_2O$ | 10.6 | $Na_2O$ | 7.1 |
| $K_2O$ | 5.1 | $K_2O$ | 7.6 |
| CaO | 8.1 | CaO | 0.7 |
| BaO | 1.7 | BaO | 8.2 |
| ZnO | 2.7 | $Al_2O_3$ | 2.7 |
| | | SrO | 8.8 |
| | | $ZrO_2$ | 2.6 |
| | | MgO | 0.6 |

Suitable borosilicate glasses, with a log R (Ωcm) at 250° C. of at least 13 have, for example one of the following compositions (% by weight), apart from possible small impurities:

| | | | |
|---|---|---|---|
| $B_2O_3$ | 15.1 | 14.5 | 13.4 |
| $Na_2O$ | <0.02 | <0.02 | <0.02 |
| $Al_2O_3$ | 10.5 | 10.1 | 10.8 |
| $SiO_2$ | 46.4 | 48.4 | 50.5 |
| $K_2O$ | <0.01 | <0.01 | <0.01 |
| $TiO_2$ | 0.7 | 0.08 | 0.09 |
| $As_2O_3$ | 1.5 | 1.3 | 1.0 |
| SrO | 0.3 | 0.4 | 0.2 |
| BaO | 25.2 | 24.9 | 23.9 |

If the front and/or rear wall are made of a glass material which comprises 20 to 30% by weight of BaO, similarly as the above-mentioned (barium) borosilicate glasses, X-ray radiation requirements can be satisfied.

If two or more spacer plates with aligned apertures are used in the picture display device, it will be important that the plates are still well aligned with respect to each other after having gone through the different temperature steps required during assembly. It is an aspect of the invention that the compaction of the glass should be smaller than 60 ppm preferably smaller than 20 ppm after 1 hour at 450° C. if this requirement is to be realized. It should be understood that the term compaction is the change in the volume that takes place, for example, in a glass object after undergoing a heat treatment (generally at temperatures below the transfer temperature of the glass). The smaller the plates, the more stringent the requirement of compaction.

Another aspect of the invention is that no window glass but special glass is used, which is not available in so many sizes and thicknesses as window glass. Notably the duct plate which occurs in some types of displays and should have a thickness of several mm, for example 2 to 4 mm, may present a problem in these larger display formats having a diagonal of approximately 20 inches or more.

This problem can be solved by constructing the duct plate from segments. For example, two segments each provided with a plurality of parallel ducts can be used and placed against each other along a plane which is parallel to the longitudinal axis of the ducts. It is efficient that said plane extends through a duct. The "chink" which then results on the bottom of the duct does not appear to have any noticeable influence on the electron transport in the duct when ducts are used whose depth is larger than their width. Possible leakage of electrons via the "chink" may be inhibited by covering the "chink" and preferably filling it with MgO, ZnO or a similar electrically insulating material. A satisfactory connection between the segments can be obtained by arranging them on a one-piece bottom plate (which is now thinner and may thus have a format which is readily available).

Figure 5:
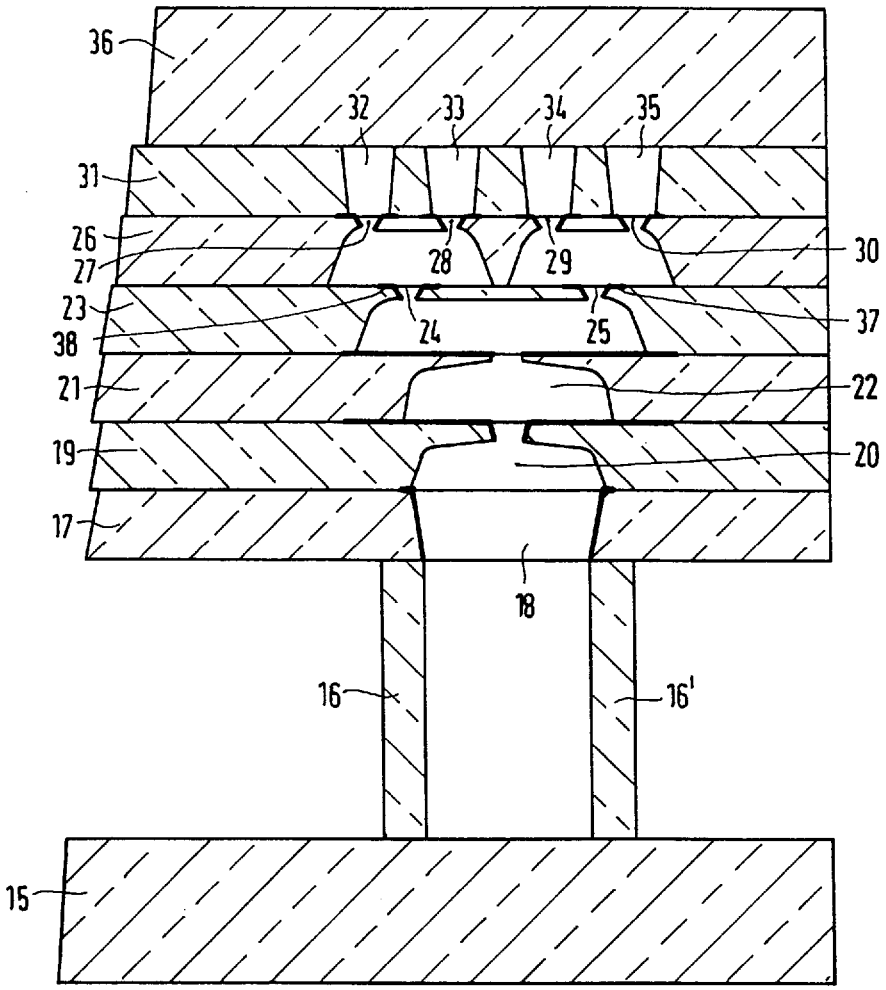
FIG. 5 shows an alternative construction.

FIG. 2 shows a diagrammatic structure in which one preselection aperture is always associated with three fine-selection apertures. A practical alternative is a structure having half the number of preselection apertures (viewed in the longitudinal direction of the propagation ducts), in which each preselection aperture is associated with two intermediate selection apertures which are separately addressable and in which each intermediate selection aperture is associated with three fine-selection apertures. This simplifies the preselection drive circuit to a considerable extent. (Another distribution of intermediate selection apertures and fine-selection apertures is of course also possible, as well as a further reduction of the number of preselection apertures per column and the use of two intermediate selection steps.) An embodiment of a structure in which the above-mentioned concept is used is shown in a diagrammatic cross-section in FIG. 5. This Figure shows a propagation duct rear wall 15, duct partitions 16, 16', a preselection plate 17 with a preselection aperture 18, a first partition 19 having a tapered aperture 20, a second partition 21 having a tapered aperture 22, an obstruction plate annex intermediate selection plate 23 having (intermediate selection) apertures 24 and 25 which are associated with aperture 18 via apertures 20 and 22 and are separately addressable by means of intermediate selection electrodes 37 and 38, a fine-selection plate 26 having a first pair of three fine-selection apertures which are associated with intermediate selection aperture 24 (only the apertures 27 and 28 of this pair are visible) and having a second pair of three fine-selection apertures which are associated with intermediate selection aperture 25 (only the apertures 29 and 30 of this pair are visible), a flu spacer plate 31 having (tapered) apertures 32, 33, 34 and 35 which correspond to the apertures 27, 28, 29 and 30 and a front panel 36 whose inner side is provided with a phosphor pattern. This stack of (eight) plates particularly leads to a satisfactorily operating display if all plates consist of borosilicate glass and preferably have a compaction of less than 60 ppm after 1 hour at 450° C.

It is to be noted that FIGS. 1 and 4 show a construction in which the cathode section $G_1$ is arranged opposite a row of entrance apertures in a short side wall of the propagation duct system, i.e. below the propagation ducts. An interesting alternative is to arrange the cathode section opposite a row of entrance apertures in the preselection plate at a position between the preselection plate and the front panel. Extra advantages are achieved if the cathode section is arranged between the partition 103 (FIG. 2) and the front panel or between the first partition 19 (FIG. 5) and the front panel opposite a row of apertures which communicate with the entrance apertures in the preselection plate.

We claim:

1. A picture display device, said device comprising: a rear wall, a face plate spaced from said rear wall and a display screen having a pattern of phosphor pixels, an addressing system arranged intermediate said rear wall and the face plate for addressing at least one pixel; and an apertured spacer plate disposed intermediate said display screen and said addressing system, said spacer plate being of an electrically insulating material for passing electrons, the spacer plate comprising a glass material having an electrical resistance R (in Ωcm) such that the log R (250° C.)≧8.

2. The picture display device as claimed in claim 1, wherein the glass material has an electrical resistance R (in Ωcm) such that the log R (250° C.)≧12.

3. The picture display device as claimed in claim 1, wherein the spacer plate comprises a glass material having a lower alkali mobility than window glass or sodium lime glass.

4. The picture display device as claimed in claim 1, wherein the glass material of the spacer plate is borosilicate.

5. The picture display device as claimed in claim 4, wherein the apertures are parallel ducts which are provided by a grinding or lapping operation.

6. The picture display device as claimed in claim 1, wherein at least one of said face plate and rear wall comprise a glass material having a linear coefficient of expansion which differs by less than $1\times10^{-6}$ from that of the spacer plate.

7. The picture display device as claimed in claim 1, including at least two additional spaced apart plates having aligned apertures, each of said additional plates comprising a glass material having an electrical resistance R (in Ωcm) such that the log R (250° C.)≧8.

8. The picture display device as claimed in claim 1, wherein the addressing system comprises an apertured addressing plate having apertures that are aligned with the apertures in the spacer plate, the addressing plate and the spacer plate each comprising a glass material having an electrical resistance R (in Ωcm) such that the log R≧8 and a compaction smaller than 60 ppm after 1 hour at 450° C.

9. The picture display device as claimed in claim 1, including apertures for propagating electrons, said apertures formed by a plurality of parallel ducts and wherein the plate comprises at least two sub-plates arranged against each other along a plane parallel to the longitudinal axis of the ducts.

10. A thin panel type picture display device having an envelope which is provided with a transparent face plate and a display screen having a pattern of phosphor pixels, said device comprising an addressing system arranged in facing relationship with a side of the face plate on which the pixels are present so as to address the desired pixels, the addressing system comprising a plate of a glass material having an electrical resistance (in Ωcm) such that the log R (250° C.)≧8.

11. The picture display device as claimed in claim 10, wherein the glass material has an electrical resistance such that the R (250° C.)≧10.

12. The picture display device as claimed in claim 11, wherein the glass material has an electrical resistance such that R (250° C.)≧12.

13. The picture display device as claimed in claim 10, wherein the plate includes apertures and is placed adjacent to the display screen.

14. The picture display device as claimed in claim 10, wherein the plate includes a patterned metal coating in a pattern and the glass material has a lower alkali mobility than window glass or sodium lime glass.

15. The picture display device as claimed in claim 10, wherein the plate consists of a glass material having a lower alkali mobility than window glass or sodium lime glass.

16. The picture display device as claimed in claim 10, wherein the glass material is borosilicate glass.

17. The picture display device as claimed in claim 10, wherein the plate comprises cavities provided by a grinding or lapping operation.

18. The picture device as claimed in claim 16, wherein the addressing system comprises at least two spaced apart plates of a glass material arranged parallel to the face plate and includes aligned apertures and further wherein the compaction is smaller than 60 ppm after 1 hour at 450° C.

19. The picture display device as claimed in claim 10, wherein the plate includes elongate cavities, and at least two sub-plates arranged against each other along a plane parallel to the longitudinal axis of the elongated cavities.

20. The picture display device as claimed in claim 10, wherein the addressing system comprises one or more glass plates, and the face plate and the plate in the addressing system is made of borosilicate.

21. The picture display device as claimed in claim 10, wherein the addressing system includes at least one glass plate; the face plate and at least one plate in the addressing system having linear coefficients of expansion that differ by less than 1*10 exp-6 from each other.

* * * * *